United States Patent [19]

Quantz

[11] 4,056,857

[45] Nov. 8, 1977

[54] CONVERTIBLE BACKPACK AND COT CONSTRUCTION

[76] Inventor: Reginald L. Quantz, 413 Magellan Place, Richmond, Canada

[21] Appl. No.: 706,235

[22] Filed: July 19, 1976

[51] Int. Cl.[2] ..... A45F 4/06

[52] U.S. Cl. ..... 5/112; 224/9

[58] Field of Search ..... 5/112, 114, 117, 184; 224/8 A, 9, 10, 25 A

[56] References Cited

U.S. PATENT DOCUMENTS

| | | | |
|---|---|---|---|
| 1,412,064 | 4/1922 | Sanford | 5/112 |
| 2,836,334 | 5/1958 | Davis | 224/9 |
| 2,964,222 | 12/1960 | Rainwater | 224/9 |
| 3,223,300 | 12/1965 | Moore et al. | 224/25 A |
| 3,620,428 | 11/1971 | Silverthorne | 5/114 |
| 3,828,992 | 8/1974 | Cerchoine | 5/112 |

*Primary Examiner*—Paul R. Gilliam
*Assistant Examiner*—Alex Grosz
*Attorney, Agent, or Firm*—Allen D. Brufsky

[57] ABSTRACT

A backpack including a tubular frame whose ends are extensible to elongate the frame to form a cot. A canvas cover on the backpack frame is also extended to serve as a support for the body of the user on the frame and is attached to the extended frame portion.

6 Claims, 2 Drawing Figures

CONVERTIBLE BACKPACK AND COT CONSTRUCTION

BACKGROUND OF THE INVENTION

The present invention generally relates to camping equipment, and more particularly to a backpack having a frame that can be extended to convert the backpack into a cot.

Camping has been increasing in popularity and, while it is conventional to carry a bedroll or sleeping bag on a backpack which can be rolled out onto the ground at night for sleeping, it is highly desirable, particularly in cold and damp environments, to sleep elevated from the ground.

SUMMARY OF THE INVENTION

Accordingly, this invention provides a backpack comprised of a tubular frame whose ends are extensible to elongate the frame into a cot. A canvas cover for the backpack is positioned on the backpack frame when extended to serve as a support the the body in a prone position.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
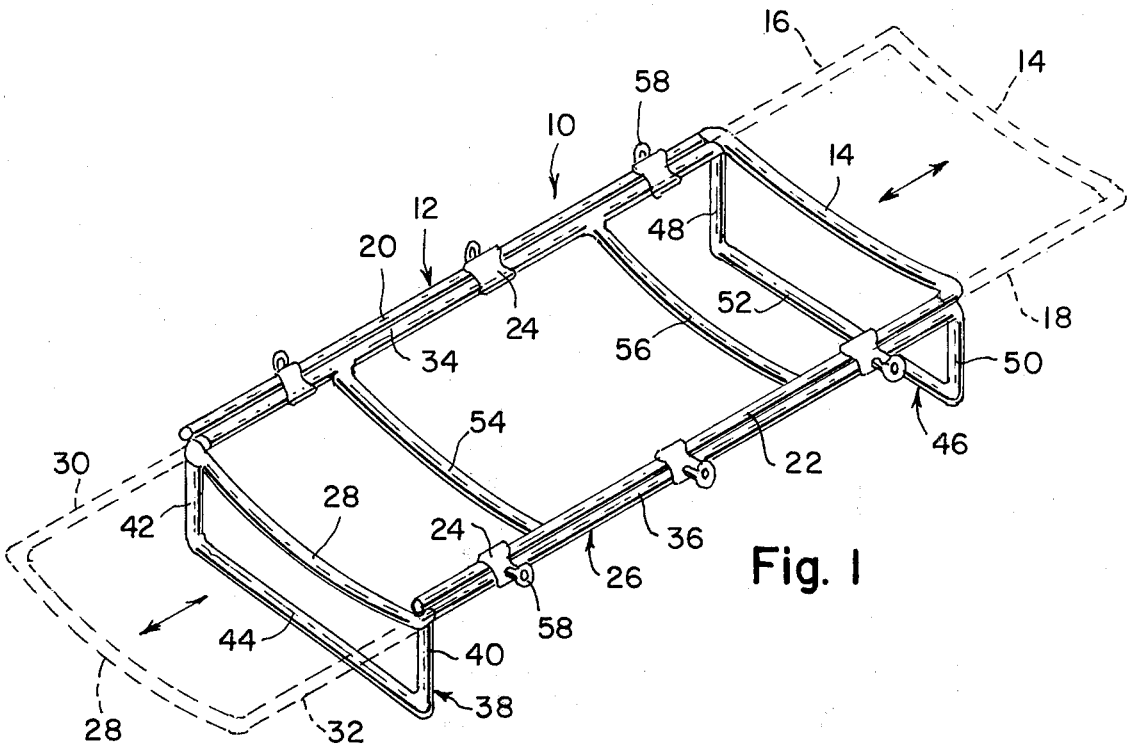
FIG. 1 is a perspective view of a backpack frame constructed in accordance with the principles of the present invention, shown extensible to a cot in phantom lines.
Figure 2:
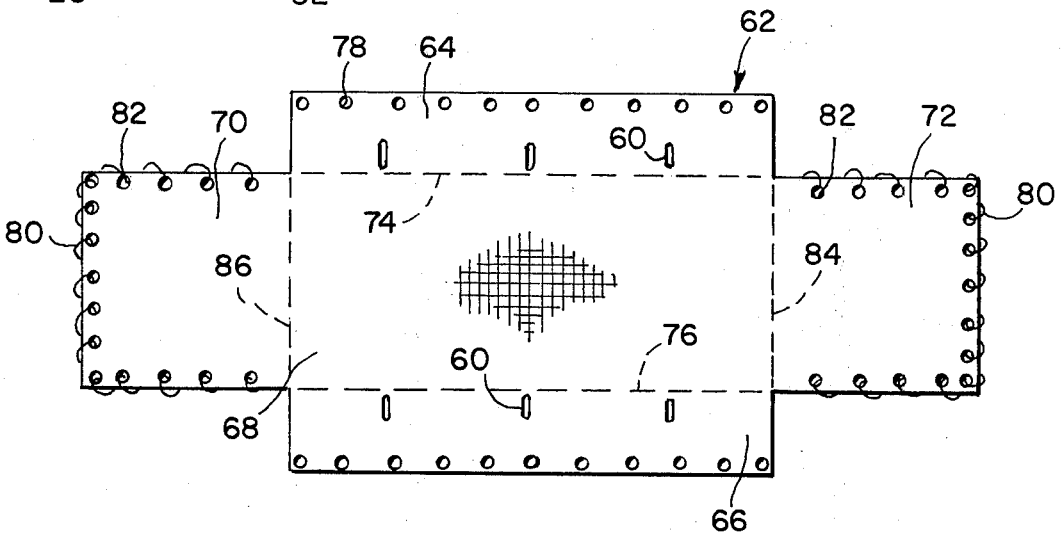
FIG. 2 is a top plan view of a canvas cover for the frame of FIG. 1.

Referring now to the drawing in detail, wherein like numerals indicate like elements throughout the several views, the backpack frame 10 is made from aluminum and comprises a first horizontal U-shaped tubular frame member 12 having an extensible bight portion 14. Bight portion 14 is connected to a first pair of telescoping leg assemblies which include legs 16 and 18 telescopically received within opposed outer legs 20 and 22, respectively of frame member 12.

Opposed outer legs 20 and 22 of tubular frame member 12 are connected by a plurality of bands or straps 24 to a second horizontal substantially U-shaped tubular frame member 26 having an extensible bight portion 28. Bight portion 28 is connected to a second pair of telescoping leg assemblies which include legs 30 and 32 telescopically received within opposed outer legs 34 and 36, respectively, of frame 26.

Connected to and depending from the opposed outer legs 34 and 36 of frame 26 is a first vertical substantially U-shaped tubular frame member 38 whose legs 40 and 42 are integrally connected to legs 34 and 36 of frame 26, respectively, and whose bight portion 44 serves to support horizontal frame members 12 and 26 above a supporting surface. Similarly, connected to and depending from the end of the opposed outer legs 34 and 36 of frame 26 is a second vertical substantially U-shaped tubular frame member 46 whose legs 48 and 50 extend downwardly from and are integral extension of legs 34 and 36 of frame 26 respectively. The bight portion 52 of frame member 46 serves to support horizontal frame members 12 and 26 above a supporting surface along with the bight portion 44 of frame member 38.

Intermediate legs 34 and 36 of horizontal tubular frame 26 are a pair of tubular braces 54 and 56. Braces 54 and 56 are concave for a purpose to be discussed hereinafter.

Attached to each strap 24 and extending laterally therefrom is an eyebolt 58. Each eyebolt 58 is received through a slit 60 in a canvas cover 62, having lateral flaps 64 and 66 connected to a main body portion 68. Longitudinal flaps 70 and 72 are also connected to main body portion 68.

After slits 60 are positioned over eyebolts 58, lateral flaps 64 and 66 of canvas cover 62 are folded about lines 74 and 76 respectively, and wrapped about the abutting legpairs 20, 34 and 22, 36 of the first and second horizontal tubular frames 12 and 26. Laces (not shown) are strung between and through holes 78 in lateral flaps 64 and 66 to secure cover 62 to the frame members 12 and 26. The main body portion 68 of cover 62 seats between the bights 14 and 28 and the aforementioned leg pairs 20, 34 and 22, 36.

With bights 14 and 28 extended to the phantom line position illustrated in FIG. 1, and the horizontal frames 12 and 26 supported by bights 44 and 52, backpack frame 10 can be used as a cot. Longitudinal flap 70 is positioned over bight 28, and extended legs 30, 32 while longitudinal flap 72 is positioned over bight 14 and extended legs 16, 18. Laces 80 are strung between adjacent holes 82 in each longitudinal flap and over the corresponding extended bight and legs to provide a head and foot support for the body of the user, while main body portion 68 of cover 62 supports in conjunction with concave braces 54 and 56 the body of the user. The curvature of braces 54 and 56 more comfortably support the body by conforming to the body.

In order to use backpack frame 10 as a backpack, flaps 70 and 72 are removed from the extended bight 28, legs 30, 32 and bight 14, legs 16, 18, respectively, and the legs telescoped back into legs 34, 36 and legs 20, 22 respectively. Flaps 70 and 72 are folded about lines 86 and 84 respectively, to encircle retracted bights 28 and 14, respectively, and the entire first and second vertical frame members 38 and 46. Material to be carried within the backpack is enclosed between the rear surface of main body 68 of cover 62 and the rear surface of the folded over flaps 70 and 72. Laces 80 are extended between holes 82 in the bottom row of the flaps 70 and 72 to secure the material in the backpack. An eyelet rod (not shown) provided with straps is inserted through each row of eyebolts 58 so the backpack frame 10 can be carried on the back of the user in a vertical position with frames 38 and 46 substantially horizontal. Once more, concave braces 54 and 56 conform to the curvature of the user's back for increased comfort.

I claim:

1. A convertible backpack and cot construction comprising:

a first horizontal substantially U-shaped tubular frame having an extensible bight portion and a first pair of telescoping leg assemblies connected to said bight portion said leg assemblies including relatively movable inner and outer legs, said inner legs being movable relative to said outer legs and connected to said bight portion permitting the extension of said bight portion relative to said outer legs;

a second horizontal substantially U-shaped tubular frame having an extensible bight portion and a second pair of telescoping leg assemblies connected to said bight portion said leg assemblies including relatively movable inner and outer legs, said inner legs being movable relative to said outer legs and connected to said bight portion permitting the extension of said bight portion relative to said outer legs;

the outer legs of said first and second telescoping leg assemblies of said first and second tubular frames being in abutment;

means for retaining the outer legs of said first and second leg assemblies in abutment;

a first and second vertical substantially U-shaped frame having their legs depending from opposite ends of the second pair of telescoping leg assemblies of said second horizontal U-shaped tubular frame with the bight portions of each vertical frame being adapted to support said horizontal frames on a surface; and cover means for said horizontal and vertical frames.

2. A convertible backpack and cot construction in accordance with claim 1 including a pair of concave braces between the second outer legs of said telescoping leg assemblies of said second horizontal U-shaped tubular frame.

3. A convertible backpack and cot construction in accordance with claim 1 wherein said cover means comprises:

a central body portion having lateral flaps;

the central body portion covering the space between the first and second outer legs of said telescoping leg assemblies of said first and second horizontal frames with said lateral flaps encircling the same; and means between said lateral flaps for connecting them together.

4. A convertible backpack and cot construction in accordance with claim 3 wherein said central body portion includes longitudinal flaps, and said longitudinal flaps include means for connecting said longitudinal flaps to the first and second horizontal frames when their respective first and second telescoping leg assemblies are extended and for connecting said flaps to each other about said first and second vertical frames when said telescoping leg assemblies are retracted.

5. A convertible backpack and cot construction in accordance with claim 1 wherein said means for retaining said first and second outer legs of said leg assemblies in abutment include a plurality of straps.

6. A convertible backpack and cot construction in accordancee with claim 5 wherein said straps include eyebolts.

* * * * *